US008529109B2

(12) United States Patent
Ohno

(10) Patent No.: US 8,529,109 B2
(45) Date of Patent: Sep. 10, 2013

(54) VEHICLE LIGHTENING UNIT

(75) Inventor: Masafumi Ohno, Kawasaki (JP)

(73) Assignee: Stanley Electric Co., Ltd., Tokyo (JP)

( * ) Notice: Subject to any disclaimer, the term of this patent is extended or adjusted under 35 U.S.C. 154(b) by 312 days.

(21) Appl. No.: 13/113,824

(22) Filed: May 23, 2011

(65) Prior Publication Data

US 2011/0286229 A1 Nov. 24, 2011

(30) Foreign Application Priority Data

May 21, 2010 (JP) ..... 2010-116937

(51) Int. Cl.
*F21S 8/10* (2006.01)
*F21V 7/00* (2006.01)

(52) U.S. Cl.
USPC ..... 362/511; 362/628; 362/520; 362/602; 362/516

(58) Field of Classification Search
USPC ..... 362/519, 511, 516, 520, 545, 555, 362/602, 603, 615, 628, 800; 385/146, 129
See application file for complete search history.

(56) References Cited

U.S. PATENT DOCUMENTS 5,711,592 A * 1/1998 Hotta ..... 362/511
7,070,312 B2 7/2006 Tatsukawa
7,828,448 B2 * 11/2010 Kim et al. ..... 362/555
7,883,249 B2 * 2/2011 Totani et al. ..... 362/511
8,382,351 B2 * 2/2013 Ishikawa et al. ..... 362/517
8,388,202 B2 * 3/2013 Ohno et al. ..... 362/520
2004/0257826 A1 12/2004 Tatsukawa
2005/0141227 A1 6/2005 Tsukamoto et al.
2005/0162857 A1 7/2005 Tsukamoto

FOREIGN PATENT DOCUMENTS

JP 2005-11704 A 1/2005
JP 2007-250233 A 9/2007
JP 4108597 B2 6/2008
JP 4113111 B2 7/2008
JP 4339028 B2 10/2009

OTHER PUBLICATIONS

List of Potentially Related Pending Applications citing U.S. Appl. No. 13/430,669 to Masafumi Ohno filed Mar. 26, 2012.

* cited by examiner

*Primary Examiner* — Bao Q Truong
(74) *Attorney, Agent, or Firm* — Kenealy Vaidya LLP

(57) ABSTRACT

A vehicle lighting unit which emits light parallel to an optical axis in a front direction can include a light source which emits light obliquely to an optical axis in the front direction and a light guiding body which guides the light emitted from the light source so as to emit the light. The light guiding body can include an incidence surface disposed to face the light source with a gap in between, the incidence surface through which the light emitted from the light source enters the light guiding body, a front surface having an exit surface and a first reflection surface, and a back surface having a second reflection surface.

6 Claims, 9 Drawing Sheets

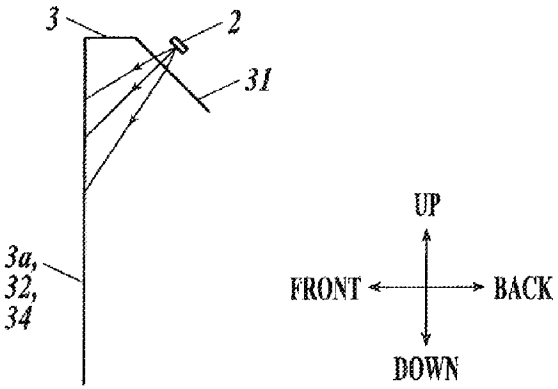
FIG. 2A
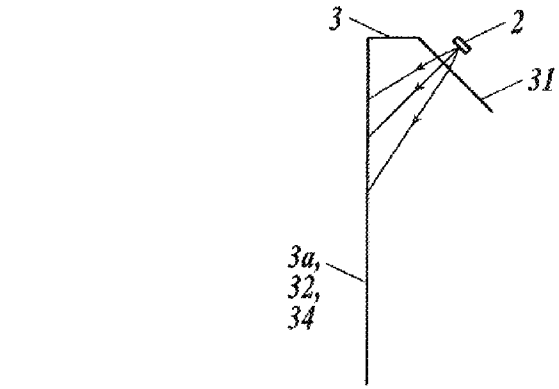
FIG. 2B
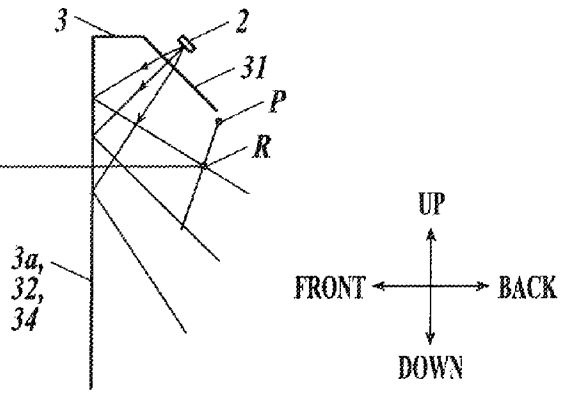
FIG. 2C
FIG. 2D

VEHICLE LIGHTENING UNIT

This application claims the priority benefit under 35 U.S.C. §119 of Japanese Patent Application No. 2010-116937 filed on May 21, 2010, which is hereby incorporated in its entirety by reference.

BACKGROUND

1. Field

The presently disclosed subject matter relates to a vehicle lightening unit.

2. Description of the Related Art

Conventionally, there is known a vehicle lightening unit in which light emitted from a light source is made to be light in a desired light-emitting mode in a light guiding body so as to be emitted from the lightening unit, for example, according to Japanese Patent No. 4113111 (Patent Document 1), Japanese Patent Application Laid-open Publication No. 2005-11704 (Patent Document 2), Japanese Patent No. 4108597 (Patent Document 3), and Japanese Patent Application Laid-open Publication No. 2007-250233 (Patent Document 4).

Patent Documents 1 and 2 disclose vehicle lightening units in each of which a light source faces straight ahead to the front of the lightening unit, namely, faces in a light emitting direction of the lightening unit, and a light guiding body is disposed to cover the front of the light source from above to below the light source (in the up/down direction). Light emitted from the light source enters the light guiding body, branches in the up/down direction, and is internally reflected twice in the front/back direction. Thereafter, the light is emitted from an exit surface of the front surface of the light guiding body. In the lightening unit disclosed in Patent Document 1, the light guiding body touches an exit surface of the light source. On the other hand, in the lightening unit disclosed in Patent Document 2, there is a gap between the light guiding body and an exit surface of the light source.

Furthermore, Patent Documents 3 and 4 disclose vehicle lightening units in each of which a light source faces downward, and a light guiding body is disposed below the light source. Light emitted from the light source enters the light guiding body, and is internally reflected once in the front/back direction. Thereafter, the light is emitted from an exit surface of the front surface of the light guiding body. In the lightening unit disclosed in Patent Document 3, the light guiding body touches an exit surface of the light source. On the other hand, in the lightening unit disclosed in Patent Document 4, there is a gap between the light guiding body and an exit surface of the light source.

However, in the lightening units disclosed in Patent Documents 1 and 2, the light source faces in the light emitting direction of the lightening unit, and accordingly, the light guiding body which takes in the light emitted from the light source is disposed to cover the front of the light source in the up/down direction, as described above. Consequently, the light guiding body becomes long in the up/down direction, and accordingly, the change of the lightening unit in thickness becomes large, the thickness which is the length in the front/back direction. That makes it difficult to accurately form the light guiding body made of transparent resin.

On the other hand, in the lightening units disclosed in Patent Documents 3 and 4, since the light guiding body is disposed below the light source, the lightening units disclosed in Patent Documents 3 and 4 can be manufactured to be smaller in the up/down direction than the lightening units disclosed in Patent Documents 1 and 2. However, in the lightening units disclosed in Patent Documents 3 and 4, the light is internally reflected only once in the front/back direction, and is emitted from the light guiding body thereafter. Consequently, the length of the light guiding body in the front/back direction becomes long.

Furthermore, in the lightening units disclosed in Patent Documents 1 and 3, since the light guiding body touches the exit surface of the light source, a problem (heat distortion of the light guiding body, for example) may occur because of heat generated by the light source.

SUMMARY

In the view of the circumstances, one aspect of the presently disclosed subject matter is to provide a vehicle lightening unit including a light guiding body which is smaller and more compact, and more accurately manufactured than a conventional light guiding body in a conventional vehicle lightening unit, and which is less influenced by heat generated by a light source.

To solve or address at least one of the problems described above, according to an aspect of the presently disclosed subject matter, there is provided a vehicle lighting unit which emits light parallel to an optical axis in a front direction, the vehicle lighting unit including: a light source which emits the light obliquely to the optical axis in the front direction; and a light guiding body which guides the light emitted from the light source so as to emit the light, the light guiding body including: an incidence surface disposed to face the light source with a gap in between, the incidence surface through which the light emitted from the light source enters the light guiding body; a front surface having an exit surface and a first reflection surface; and a back surface having a second reflection surface, wherein the light which enters the light guiding body through the incidence surface is internally reflected by the first reflection surface in a back direction, and the light which is internally reflected by the first reflection surface is internally reflected by the second reflection surface in the front direction to the exit surface so that the light is emitted from the light guiding body through the exit surface while the light is made to be parallel to the optical axis in the front direction.

BRIEF DESCRIPTION OF THE DRAWINGS

The above and other characteristics, advantageous and features of the presently disclosed subject matter will become more fully understood from the detailed description given hereinbelow and the appended drawings which are given by way of illustration only, and thus are not intended as a definition of the limits of the presently disclosed subject matter, wherein:

FIGS. 2A to 2D are illustrations for explaining how to decide the back surface of a light guiding body of the lightening unit according to the embodiment of FIG. 1A;

DESCRIPTION OF EXEMPLARY EMBODIMENTS

Figure 1A:
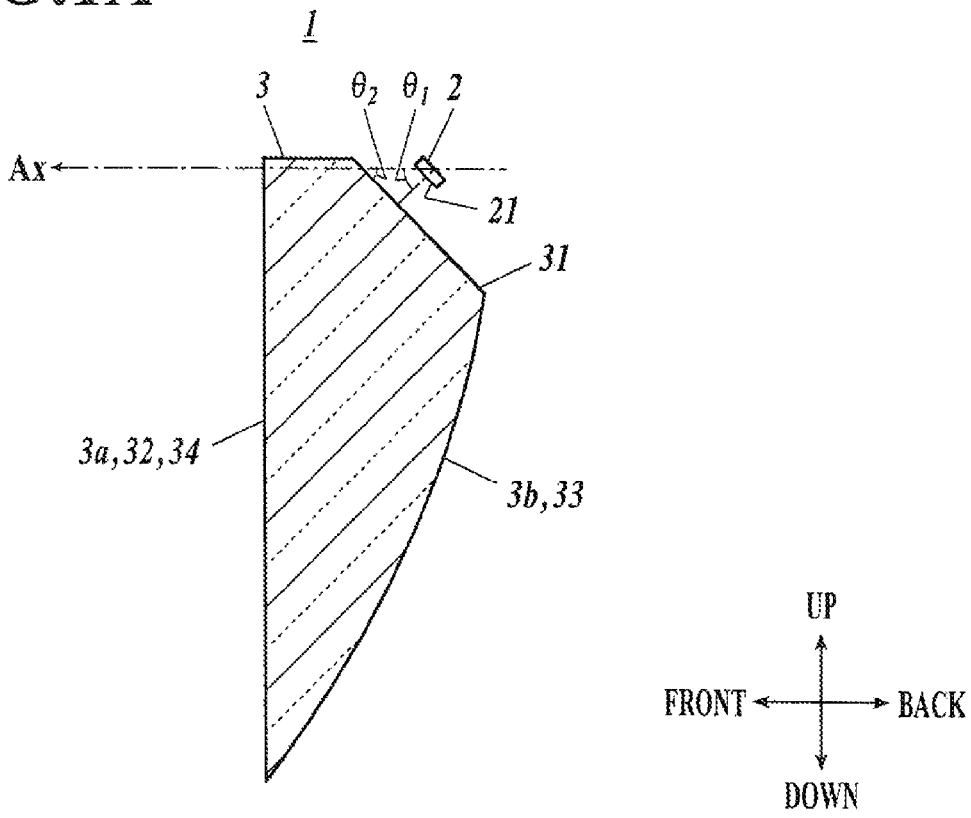
FIG. 1A is a sectional side view of a vehicle lightening unit according to an exemplary embodiment of the presently disclosed subject matter.

Hereinafter, an embodiment of the presently disclosed subject matter is described in detail referring to the drawings. The drawings are given by way of illustration only, and thus are not intended to limit the scope of the presently disclosed subject matter.

Figure 1B:
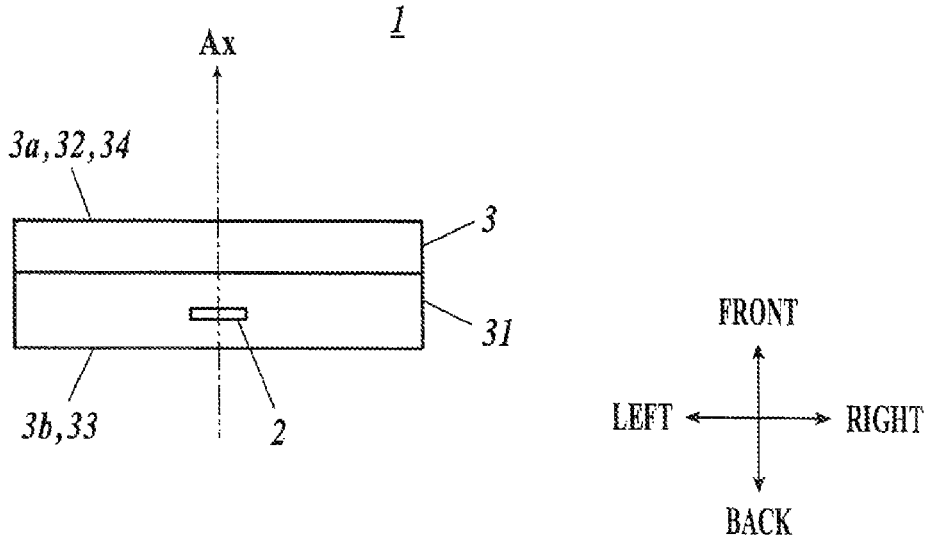
FIG. 1B is a plan view thereof.

FIG. 1A is a sectional side view of a vehicle lightening unit 1 according to an embodiment of the presently disclosed subject matter, and FIG. 1B is a plan view of the lightening unit 1.

As shown in FIGS. 1A and 1B, the lightening unit 1 can include a light source 2 and a light guiding body 3, and can emit light parallel to an optical axis Ax in the front direction.

The light source 2 is composed of a light emitting element such as a light emitting diode. The light source 2 is disposed to emit light obliquely to the optical axis Ax in the front direction. More specifically, and for example, on a vertical sectional in the front/back direction of the lightening unit 1, an exit surface 21 of the light source 2 faces obliquely downward in the front direction in such a way that an angle $\theta_1$ between a central axis in a light emitting direction of the light source 2 and the optical axis Ax is 45±10°.

The light guiding body 3 is a translucent member. The light guiding body 3 is disposed obliquely downward to the light source 2 in front of the light source 2. The light guiding body 3 receives light emitted from the light source 2, and guides the light in such a way as to be parallel to the optical axis Ax, and emits the light parallel to the optical axis Ax from the light guiding body 3.

At the upper back part of the light guiding body 3, an incidence surface 31 is formed, the incidence surface through which the light emitted from the light source 2 enters the light guiding body 3. The incidence surface 31 faces the exit surface 21 of the light source 2 with a gap in between in such a way that on the vertical sectional in the front-back direction of the lightening unit 1, an angle $\theta_2$ between the incidence surface 31 and the optical axis Ax is 45±10° in order that the incidence surface 31 be almost parallel to the exit surface 21.

A front surface 3*a* of the light guiding body 3 is a plane surface. In other words, the front surface 3*a* is curved in neither the up/down direction nor the right/left direction. As described below, the front surface 3*a* includes a first reflection surface 32 and an exit surface 34. By the first reflection surface 32, the light is internally reflected in the back direction, the light which enters the light guiding body 3 through the incidence surface 31. By the exit surface 34, the light is emitted from the light guiding body 3.

On the other hand, a back surface 3*b* of the light guiding body 3 is a curved surface. The back surface 3*b* is curved to reach the lower end of the front surface 3*a* in such a way that the light guiding body 3 tapers to the lower end of the light guiding body 3 on the vertical section in the front/back direction of the lightening unit 1. As described below, the light guiding body 3 includes a second reflection surface 33 by which the light internally reflected by the first reflection surface 32 is internally reflected again in such a way that the light travels to the exit surface 34 while being parallel to the optical axis Ax.

Here, how to decide the shape of the back surface 3*b* (second reflection surface 33) of the light guiding body 3 on a vertical section in the front/back direction of the light guiding body 3 is described.

First, as shown in FIG. 2A, on the assumption that light is emitted from the light source 2 in a prescribed range, light rays of the light are traced to the front surface 3*a* of the light guiding body 3 by taking account of refraction of the light rays on the incidence surface 31.

Next, as shown in FIG. 2B, the light rays are further traced on the assumption that the light rays are totally reflected by the front surface 3*a* (first reflection surface 32) of the light guiding body 3.

Next, as shown in FIG. 2C, by taking a starting point P at the back side of the light guiding body 3 as a prescribed starting point, a first slope angle at a reflection point R is decided in such a way that a first light ray from the top among the traced light rays is totally reflected in the front direction so as to be parallel to the optical axis Ax.

Next, a second slope angle at an intersection point of the decided line having the first slope angle with a second light ray from the top among the traced light rays is decided.

As shown in FIG. 2*d*, with regard to all of the traced light rays, slope angles at their respective intersection points are decided successively. Then, the reflection point R, the intersection points, the lower end of the incidence surface 31, and the lower end of the front surface 3*a* are connected by a spline curve.

Thus, the shape of the back surface 3*b* on the vertical section in the front/back direction of the light guiding body 3 is decided. In the light guiding body 3 according to the embodiment, the shape of the back surface 3*b* is the same in the right/left direction. Hence, the same condition, which is described above, is held on any vertical section in the front/back direction of the light guiding body 3 taken at any position in the right/left direction, the vertical section which includes the light rays as shown in FIG. 2B.

Figure 3A:
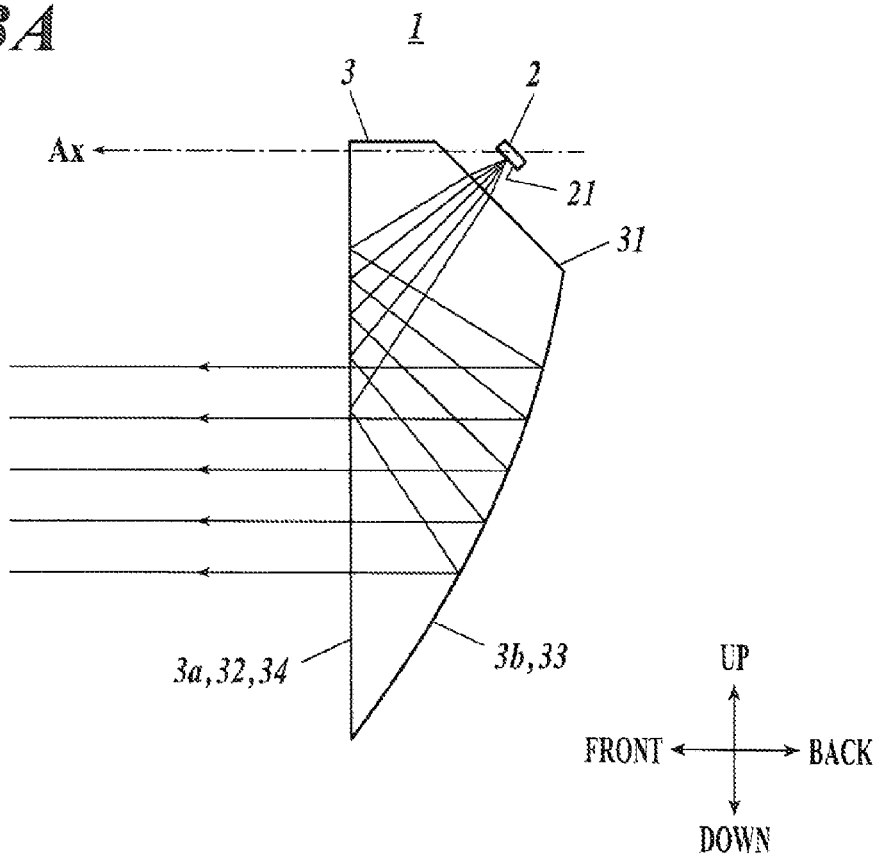
FIGS. 3A and 3B are illustrations for explaining a light emitting mode of the lightening unit according to the embodiment of FIG. 1A.
Figure 3B:
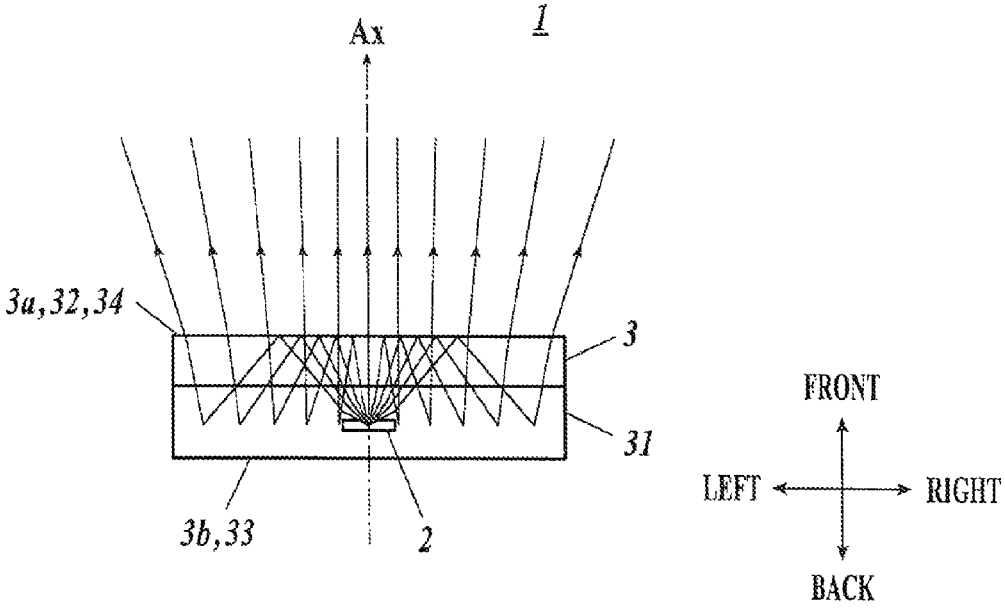

In the lightening unit 1, as shown in FIGS. 3A and 3B, the light source 2 emits light obliquely downward to the optical axis Ax in the front direction, and the light enters the light guiding body 3 through the incidence surface 31. The light is internally reflected by the front surface 3*a* (first reflection surface 32) of the light guiding body 3 in the back direction, internally reflected again by the back surface 3*b* (second reflection surface 33) of the light guiding body 3 in the front direction in such a way that the light is parallel to the optical axis Ax in the front direction when the light is emitted from the light guiding body 3, and thereafter, emitted from the light guiding body 3 through the front surface 3*a* (exit surface 34) thereof. Thus, the light which is parallel to the optical axis Ax can be obtained.

As described above, according to the lightening unit 1, the light source 2 emits light obliquely to the optical axis Ax in the front direction. Therefore, unlike a conventional lightening unit in which a light source faces straight ahead to the front of the lightening unit (in the light emitting direction), it is not necessary, in the lightening unit 1, to dispose the light guiding body 3 to cover the front of the light source 2 from above to below the light source 2. That is, the light emitted from the light source 2 can be efficiently taken in by the light guiding body 3 of the lighting unit 1. Thus, the light guiding body 3 of the lightening unit 1 can be manufactured to be smaller in the up/down direction and more compact than a conventional light guiding body of a conventional lightening unit.

Accordingly, the change of the light guiding body 3 in thickness becomes less than a conventional guiding body, and hence, the light guiding body 3 can be more accurately manufactured than a conventional light guiding body. Consequently, manufacturing costs of the lightening unit 1 can be reduced.

Furthermore, after the light which enters the light guiding body 3 through the incidence surface 31 is internally reflected by the first reflection surface 32 in the back direction, the light is internally reflected by the second reflection surface 33 in the front direction to the exit surface 34 in such a way that the light is parallel to the optical axis Ax in the front direction when the light is emitted from the light guiding body 3. Then, the light parallel to the optical axis Ax is emitted from the light guiding body 3 through the exit surface 34. That is, the light is reflected inside the light guiding body 3 twice in the front/back direction, and then emitted from the light guiding body 3 through the exit surface 34. Accordingly, the light guiding body 3 can be manufactured to be smaller in the front/back direction and more compact than a conventional light guiding body from which the light is emitted after internally reflected only once.

Furthermore, the incidence surface 31 of the light guiding body 3 faces the light source 2 with a gap in between. Accordingly, influence of heat on the light guiding body 3, the heat which is generated by the light source 2, can be reduced as compared with a conventional lightening unit in which a light guiding body touches a light source.

[Modification]

Next, a modification from the above-described embodiment is described. The same reference numerals are given without adding explanations for those components which can be the same as the above-described embodiment.

Figure 4:
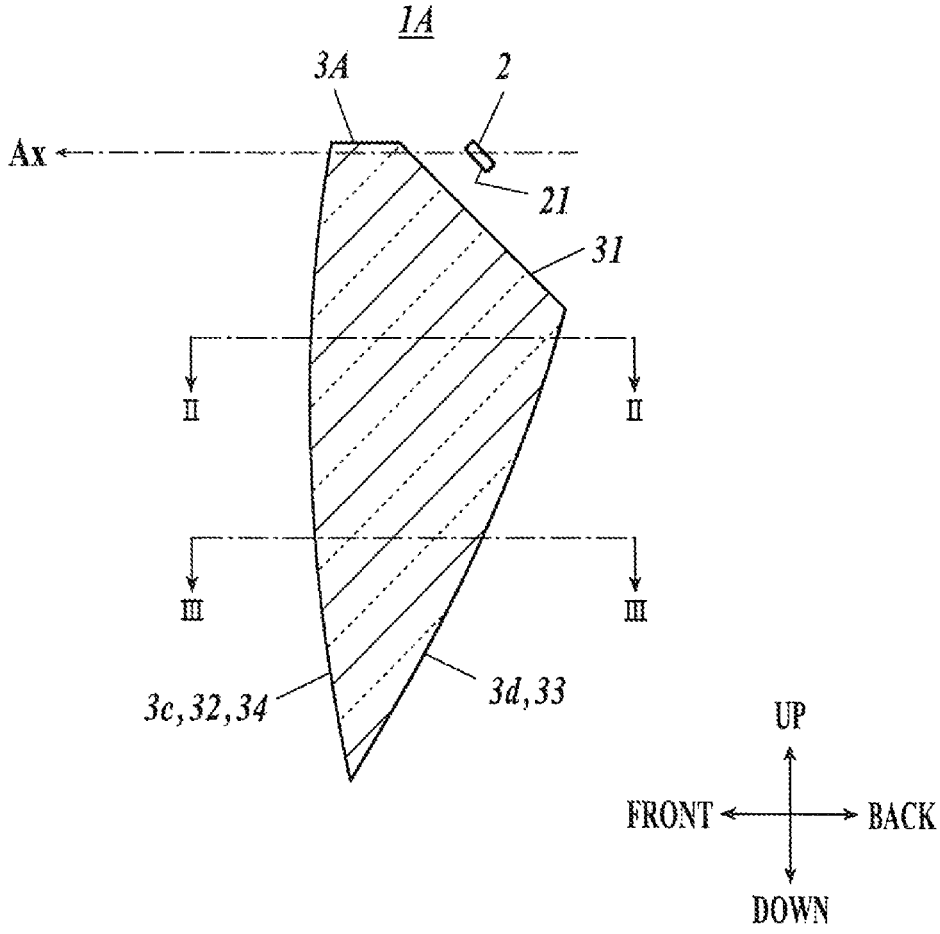
FIG. 4 is a sectional side view of a vehicle lightening unit according to a modification from the embodiment of FIG. 1A.
Figure 5A:
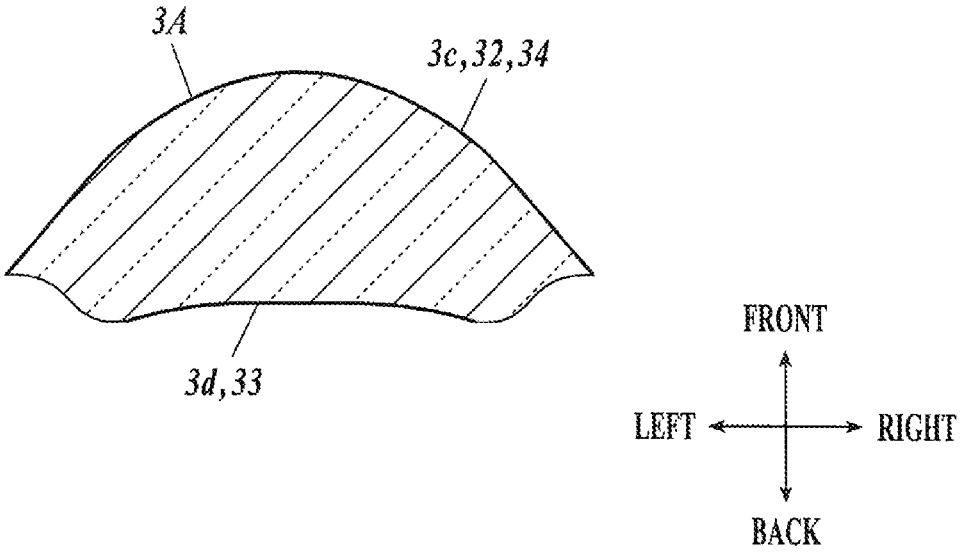
FIG. 5A is a sectional view taken along the line II-II of FIG. 4.
Figure 5B:
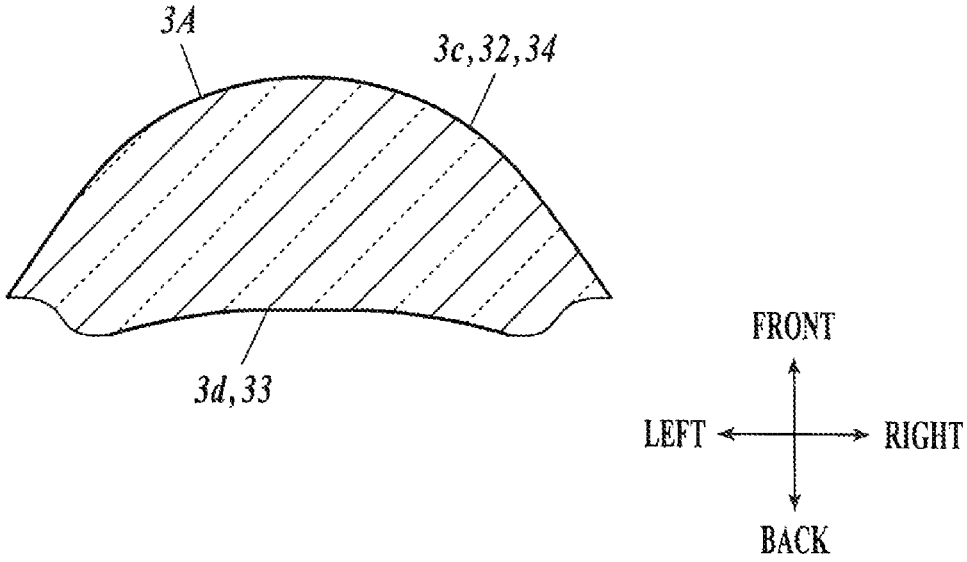
FIG. 5B is a sectional view taken along the line III-III of FIG. 4.

FIG. 4 is a sectional side view of a vehicle lightening unit 1A according to the modification, FIG. 5A is a sectional view taken along the line II-II of FIG. 4, and FIG. 5B is a sectional view taken along the line III-III of FIG. 4.

As shown in FIGS. 4, 5A, and 5B, the lightening unit 1A includes a light guiding body 3A instead of the light guiding body 3.

A difference between the light guiding body 3 in the embodiment of FIG. 1A and the light guiding body 3A in the modification is that while the light guiding body 3 has the front surface 3*a* which is plane, the light guiding body 3A has a front surface 3*c* which is curved in the up/down direction and in the right/left direction so as to be convex in the front direction. Because of the curved front surface 3*c*, the light guiding body 3A has a back surface 3*d* which is curved differently from the back surface 3*b* in the embodiment of FIG. 1A.

Here, how to decide the shape of the back surface 3*d* (second reflection surface 33) of the light guiding body 3A on a vertical sectional in the front/back direction of the light guiding body 3A is described.

Figure 6A:
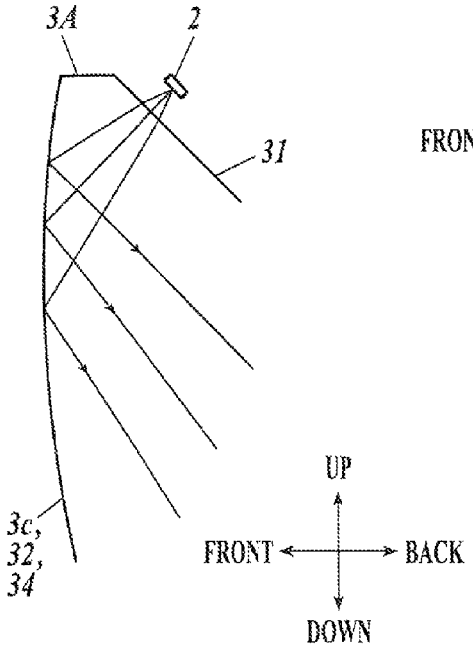
FIGS. 6A to 6C are illustrations for explaining how to decide the back surface of the light guiding body of the lightening unit of FIG. 4.

First, as shown in FIG. 6A, on the assumption that light is emitted from the light source 2 in a prescribed range, light rays of the light are traced to the front surface 3*c* of the light guiding body 3A by taking account of refraction of the light rays on the incidence surface 31. The light rays are further traced on the assumption that the light rays are totally reflected by the front surface 3*c* (first reflection surface 32) of the light guiding body 3A thereafter as shown in FIG. 6A.

Figure 6B:
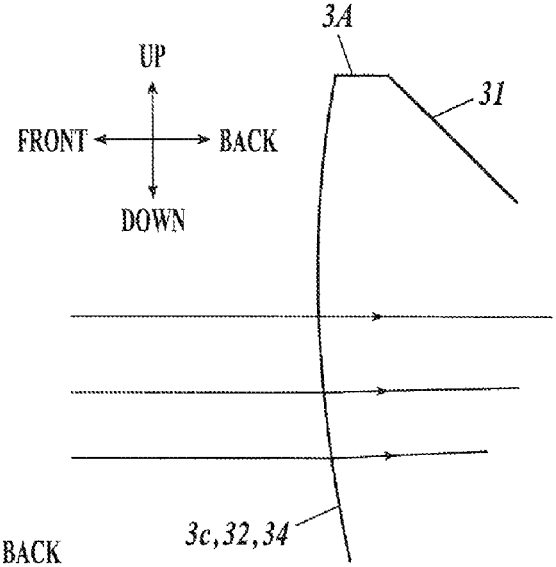

Next, as shown in FIG. 6B, light rays parallel to the optical axis Ax to be emitted from the light guiding body 3A through the front surface 3*c* are traced in the back direction to the back side of the light guiding body 3A by taking account of refraction on the front surface 3*c* (exit surface 34).

Figure 6C:
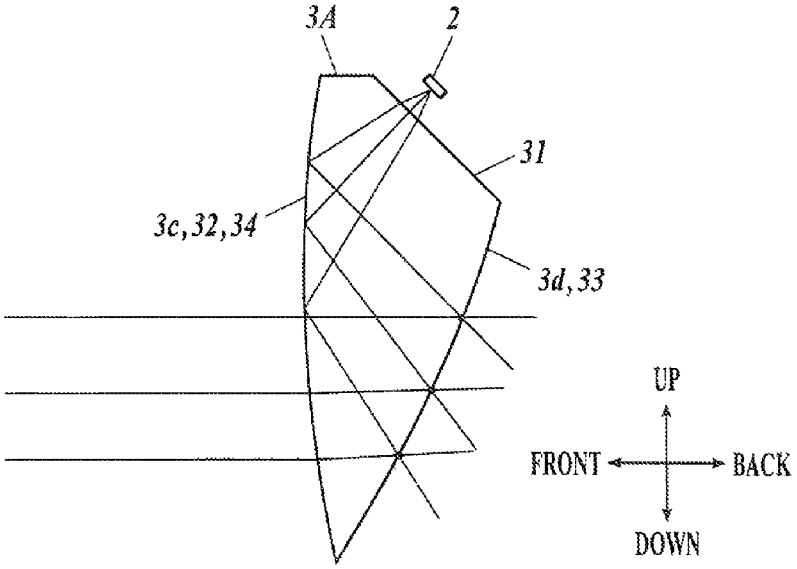

Next, as shown in FIG. 6C, an intersection point of a light ray traced from the light source 2 with a light ray traced in the back direction from the front surface 3*c* is obtained. Then, a slope angle at the intersection point is decided in such a way that when the light ray is totally reflected at the intersection point, the light ray traced from the light source 2 becomes the light ray traced in the back direction from the front surface 3*c*, and vice versa.

With regard to all of the light rays traced from the light source 2 and their respective light rays traced from the front surface 3*c*, their respective insertion positions are obtained, and slope angles at their respective insertion points are decided successively. Then, the intersection points, the lower end of the incidence surface 31, and the lower end of the front surface 3*c* are connected by a spline curve.

Thus, the shape of the back surface 3*d* on the vertical section in the front/back direction of the light guiding body 3 is decided.

Figure 7A:
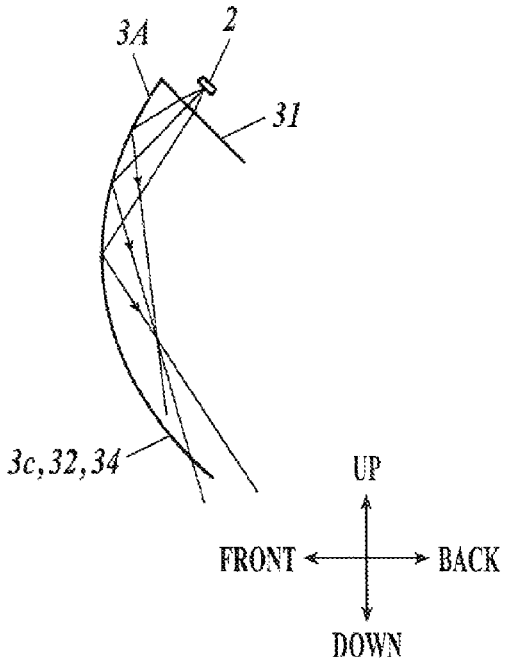
FIGS. 7A to 7C are illustrations for explaining a condition under which the back surface of the light guiding body according to FIG. 4 may not be formed.
Figure 7B:
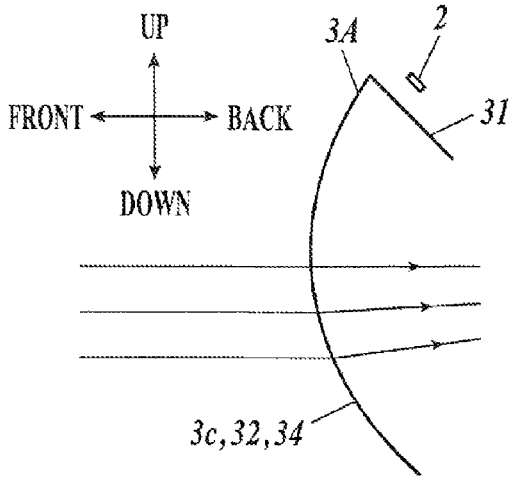
Figure 7C:
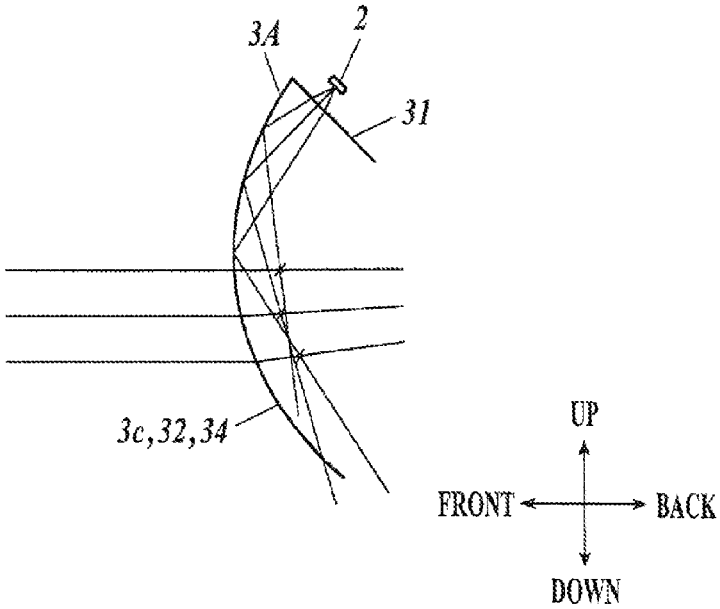

However, when the curvature of the front surface 3*c* is so large that the light rays (assumed light rays) which are traced from the light source 2 and next to each other intersect as shown in FIG. 7A, the back surface 3*d* cannot be formed. That is, in such a case, even when the light rays traced in the back direction from the front surface 3*c* do not intersect as shown in FIG. 7B, the slope angles at their respective intersection points cannot be made in such a way that the intersection points are connected by a spline curve. In order to form the back surface 3*d*, it is necessary that the light rays which are traced from the light source 2 and next to each other are gradually separated from each other from the front surface 3*c* in the back direction, for example, as shown in FIG. 6C. Accordingly, the front surface 3*c* is required to fill that condition when formed. In addition, when the incidence surface 31 is curved, it is a matter of course that the incidence surface 31 is also required to fill the condition when formed.

The effects obtained by the lightening unit 1 can be obtained by the lightening unit 1A too.

The presently disclosed subject matter is not limited to the embodiment and the modification described above, and hence, can be appropriately changed without departing from the scope of the presently disclosed subject matter.

Figure 8A:
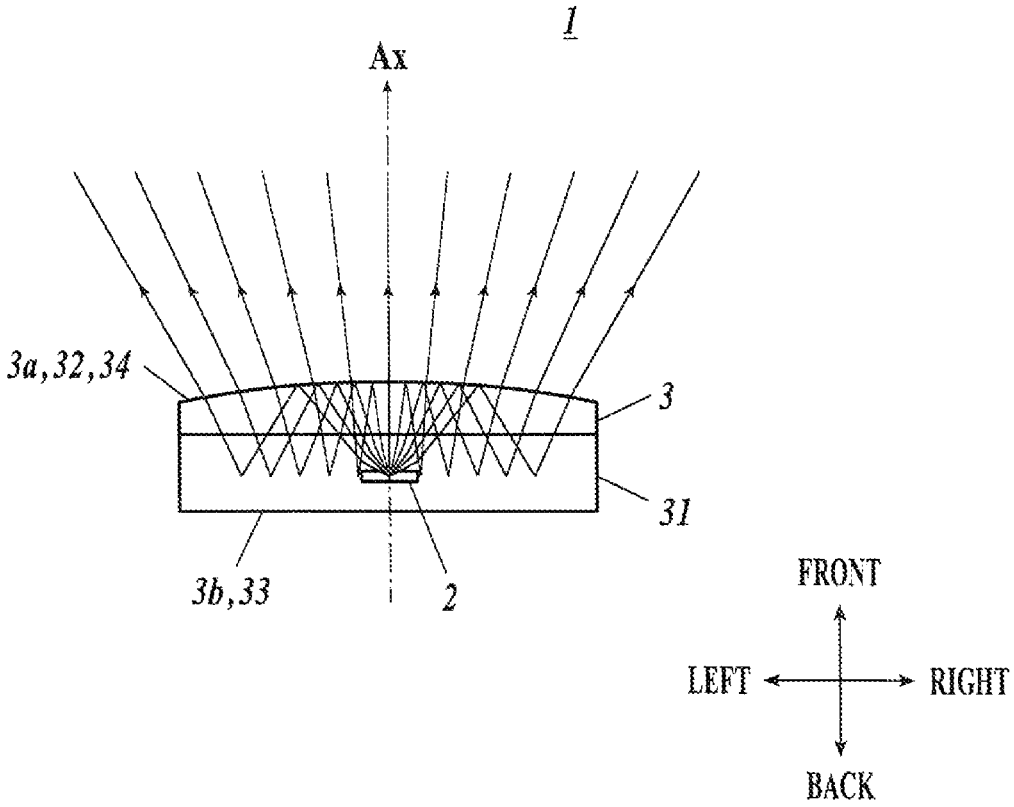
FIG. 8A is a plan view of the lightening unit of FIG. 1A, the lightening unit in which the front surface of the light guiding body is made to be convex.
Figure 8B:
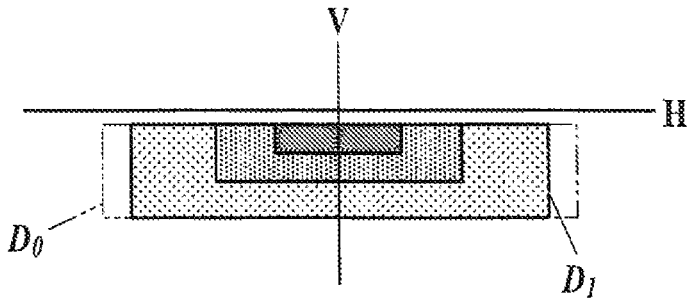
FIG. 8B shows a light distribution pattern in the case where the front surface is convex.
Figure 9A:
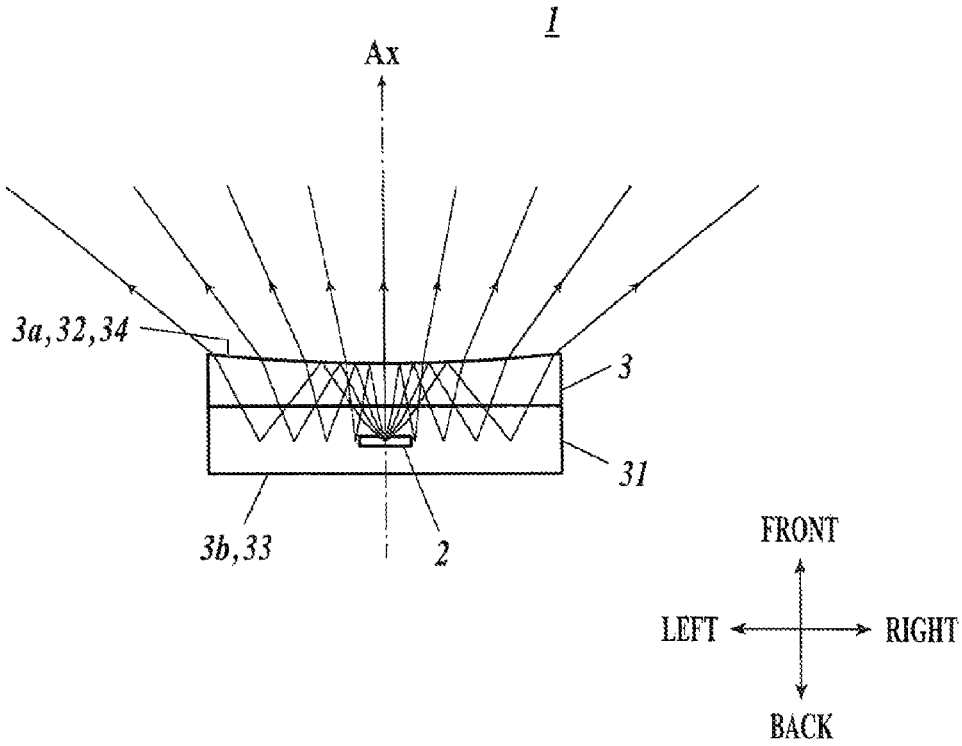
FIG. 9A is a plan view of the lightening unit of FIG. 1A, the lightening unit in which the front surface of the light guiding body is made to be concave.
Figure 9B:
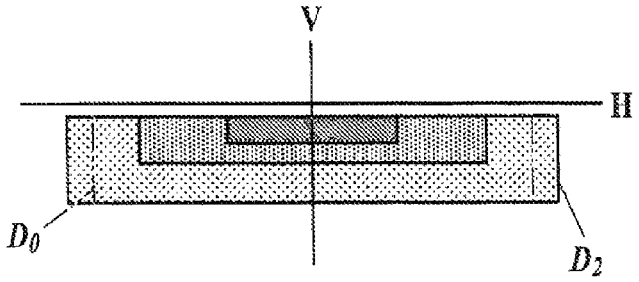
FIG. 9B is a light distribution pattern in the case where the front surface is concave.

For example, in the embodiment of FIG. 1A, the front surface 3*a* of the light guiding body 3 is plane, but may be curved in accordance with a desired light distribution pattern. For example, when the front surface 3*a* is curved to be convex in the front direction as shown in FIG. 8A as the front surface 3*c* in the modification is curved, a light distribution pattern $D_1$ can be obtained as shown in FIG. 8B. The light distribution pattern $D_1$ is narrower in the right/left direction (horizontal direction) than a light distribution pattern $D_0$ obtained when the front surface 3*a* is plane. On the other hand, when the front surface 3*a* is curved to be concave in the front direction as shown in FIG. 9A, a light distribution pattern $D_2$ can be obtained as shown in FIG. 9B. The light distribution pattern $D_2$ is wider in the right/left direction (horizontal direction) than the light distribution pattern $D_0$ obtained when the front surface 3*a* is plane.

Furthermore, in the embodiment of FIG. 1A and the modification, the light source 2 emits light obliquely downward to the optical axis Ax in the front direction. However, this is not a limit. As long as the light source 2 emits light obliquely to the optical axis Ax in the front direction, for example, the light source may emit light obliquely sideward (rightward/leftward) to the optical axis in the front direction. In such a case, it is a matter of course to make other necessary changes in accordance with the change of the light emitting direction of the light source 2 so that the light guiding body 3 or 3A receives the light emitted from the light source 2.

Furthermore, in the embodiment of FIG. 1A and the modification, the first reflection surface 32 and the exit surface 34 are connected to be formed on one surface such as the front surface 3*a* or 3*c*. However, the first reflection surface 32 and the exit surface 34 may be formed on separate surfaces.

The incidence surface 31 of the light guiding body 3 or 3A may be a plane surface as shown in the drawings, or may be a curved surface.

According to an aspect of the presently disclosed subject matter, there is provided a vehicle lighting unit which emits light parallel to an optical axis in a front direction, the vehicle lighting unit including: a light source which emits the light obliquely to the optical axis in the front direction; and a light guiding body which guides the light emitted from the light source so as to emit the light, the light guiding body including: an incidence surface disposed to face the light source with a gap in between, the incidence surface through which the light emitted from the light source enters the light guiding body; a front surface having an exit surface and a first reflection surface; and a back surface having a second reflection surface, wherein the light which enters the light guiding body through the incidence surface is internally reflected by the first reflection surface in a back direction, and the light which is internally reflected by the first reflection surface is internally reflected by the second reflection surface in the front direction to the exit surface so that the light is emitted from the light guiding body through the exit surface while the light is made to be parallel to the optical axis in the front direction.

The light source can be configured to emit the light at 45±10 degrees to the optical axis.

The first reflection surface can be connected to the exit surface.

According to the above-described embodiments and modifications of the presently disclosed subject matter, the light source emits light obliquely to the optical axis in the front direction. Therefore, unlike a conventional lightening unit in which a light source faces straight ahead to the front of the lightening unit (in the light emitting direction), it is not necessary, in the lightening unit, to dispose the light guiding body to cover the front of the light source from above to below the light source. That is, the light emitted from the light source can be efficiently taken in by the light guiding body of the lighting unit. Thus, the light guiding body of the lightening unit can be manufactured to be smaller in the up/down direction and more compact than a conventional light guiding body of a conventional lightening unit.

Accordingly, the change of the light guiding body in thickness becomes less than a conventional guiding body, and hence, the light guiding body can be more accurately manufactured than a conventional light guiding body. Consequently, manufacturing costs of the lightening unit can be reduced.

Furthermore, after the light which enters the light guiding body through the incidence surface is internally reflected by the first reflection surface in the back direction, the light is internally reflected by the second reflection surface in the front direction to the exit surface in such a way that the light is parallel to the optical axis in the front direction when the light is emitted from the light guiding body. Then, the light parallel to the optical axis is emitted from the light guiding body through the exit surface. That is, the light is reflected inside the light guiding body twice in the front/back direction, and then emitted from the light guiding body through the exit surface. Accordingly, the light guiding body can be manufactured to be smaller in the front/back direction and more compact than a conventional light guiding body from which the light is emitted after internally reflected only once.

Furthermore, the incidence surface of the light guiding body faces the light source with a gap in between. Accordingly, influence of heat on the light guiding body, the heat which is generated by the light source, can be reduced as compared with a conventional lightening unit in which a light guiding body touches a light source.

The entire disclosure of Japanese Patent Application No. 2010-116937 filed on May 21, 2010 including description, claims, drawings, and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. A vehicle lighting unit configured to emit light parallel to an optical axis of the vehicle lighting unit in a front direction, the vehicle lighting unit comprising:

a light source configured to emit light obliquely with respect to the optical axis and towards the front direction; and a light guiding body configured to guide the light emitted from the light source so as to emit the light, the light guiding body including:

an incidence surface disposed to face the light source with a gap in between, the incidence surface configured to allow the light emitted from the light source to enter the light guiding body;

a front surface having an exit surface and a first reflection surface; and a back surface having a second reflection surface, wherein the light guiding body is configured such that light which enters the light guiding body through the incidence surface is internally reflected by the first reflection surface in a back direction, and light which is internally reflected by the first reflection surface is internally reflected by the second reflection surface in the front direction to the exit surface such that the light is emitted from the light guiding body through the exit surface and the light is parallel with the optical axis in the front direction.

2. The vehicle lightening unit according to claim 1, wherein the light source is configured to emit the light at 45±10 degrees with respect to the optical axis.

3. The vehicle lightening unit according to claim 1, wherein the first reflection surface is connected to the exit surface.

4. The vehicle lightening unit according to claim 1, wherein the first reflection surface is a planar surface.

5. The vehicle lightening unit according to claim 1, wherein the first reflection surface is a curved surface.

6. The vehicle lightening unit according to claim 1, wherein the light source is a light emitting diode.

* * * * *